US007223117B2

(12) United States Patent
Pratt

(10) Patent No.: US 7,223,117 B2
(45) Date of Patent: May 29, 2007

(54) CIRCUIT MARKER APPARATUS

(75) Inventor: Jerome A. Pratt, Round Rock, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/196,229

(22) Filed: Aug. 3, 2005

(65) Prior Publication Data

US 2007/0004273 A1 Jan. 4, 2007

Related U.S. Application Data

(63) Continuation-in-part of application No. 11/170,956, filed on Jun. 30, 2005.

(51) Int. Cl.
*H01R 4/24* (2006.01)

(52) U.S. Cl. ..... 439/409; 439/491

(58) Field of Classification Search ..... 439/409, 439/488, 491
See application file for complete search history.

(56) References Cited

U.S. PATENT DOCUMENTS

| | | | | |
|---|---|---|---|---|
| 3,067,403 | A | 12/1962 | Kulka | |
| 4,227,762 | A | 10/1980 | Scheiner | |
| 4,508,411 | A | 4/1985 | Hughes et al. | |
| 4,541,679 | A | 9/1985 | Fiedler et al. | |
| 4,795,363 | A | 1/1989 | Scherer et al. | |
| 4,815,988 | A | 3/1989 | Scherer | |
| 4,820,193 | A * | 4/1989 | Noorily | 439/488 |
| 4,932,894 | A | 6/1990 | Scherer | |
| 4,995,829 | A | 2/1991 | Geib et al. | |
| 5,080,607 | A | 1/1992 | Cristescu | |
| 5,178,558 | A | 1/1993 | Knox et al. | |
| 5,281,163 | A | 1/1994 | Knox et al. | |
| 5,435,747 | A | 7/1995 | Franckx et al. | |
| 5,503,572 | A | 4/1996 | White et al. | |
| 5,504,654 | A | 4/1996 | Knox et al. | |
| 5,529,513 | A | 6/1996 | Lee | |
| 5,538,438 | A | 7/1996 | Orlando | |
| RE35,325 | E | 9/1996 | Wass et al. | |
| 5,695,361 | A | 12/1997 | Elisei | |
| 5,741,153 | A * | 4/1998 | Schwer | 439/491 |

(Continued)

FOREIGN PATENT DOCUMENTS

DE 31 45 483 A1 5/1983

(Continued)

OTHER PUBLICATIONS

U.S. Appl. No. 10/941,441; Xavier Fasce et al, filed Sep. 15, 2004, entitled "Connector Assembly for Housing Insulation Displacement Elements".

(Continued)

*Primary Examiner*—Tho D. Ta
(74) *Attorney, Agent, or Firm*—John A. Burtis; Janet A. Kling

(57) ABSTRACT

A circuit marker bearing a visual indicium is configured to removably attach to an access cover of an insulation displacement connector block. The circuit marker comprises a body adapted to attach to the access cover, means for attaching the body to the access cover, where the means includes at least one projection extending from the body and is adapted to engage with a recess formed in the access cover.

25 Claims, 7 Drawing Sheets

U.S. PATENT DOCUMENTS

| | | | | |
|---|---|---|---|---|
| 5,762,518 | A | 6/1998 | Tanigawa et al. | |
| 5,785,548 | A | 7/1998 | Capper et al. | |
| 5,797,759 | A | 8/1998 | Mattis et al. | |
| 5,836,791 | A | 11/1998 | Waas et al. | |
| 5,971,795 | A | 10/1999 | Daoud et al. | |
| 6,015,312 | A | 1/2000 | Escane | |
| 6,099,343 | A | 8/2000 | Bonvallat et al. | |
| 6,102,731 | A | 8/2000 | Daoud | |
| 6,152,760 | A | 11/2000 | Reeser | |
| 6,159,036 | A | 12/2000 | Daoud | |
| 6,188,560 | B1 | 2/2001 | Waas | |
| 6,193,556 | B1 | 2/2001 | Escane | |
| 6,222,717 | B1 | 4/2001 | Waas et al. | |
| 6,254,420 | B1 | 7/2001 | Letailleur et al. | |
| 6,254,421 | B1 | 7/2001 | Denovich et al. | |
| 6,283,785 | B1 | 9/2001 | Daoud | |
| 6,371,794 | B1 | 4/2002 | Bauer et al. | |
| 6,406,324 | B1 | 6/2002 | Duesterhoeft et al. | |
| 6,421,941 | B1 * | 7/2002 | Finke et al. | 40/611.05 |
| 6,672,895 | B2 | 1/2004 | Scheiner | |
| 2003/0049961 | A1 | 3/2003 | Tricaud et al. | |

FOREIGN PATENT DOCUMENTS

| | | | |
|---|---|---|---|
| EP | 0 271 413 | | 6/1988 |
| EP | 0 708 497 | A2 | 4/1996 |
| EP | 1 069 578 | A1 | 1/2001 |
| EP | 1 130 685 | A2 | 9/2001 |
| FR | 2 730 096 | | 8/1996 |
| GB | 2 129 628 | | 5/1984 |
| GB | 2 149 231 | | 6/1985 |
| WO | WO 97/20367 | | 6/1997 |
| WO | WO 99/04454 | | 1/1999 |
| WO | WO 99/04455 | | 1/1999 |

OTHER PUBLICATIONS

U.S. Appl. No. 10/941,506; Xavier Fasce et al, filed Sep. 15, 2004, entitled "Insulation Displacement System for Two Electrical Conductors".

U.S. Appl. No. 29/213,197; Xavier Fasce et al, filed Sep. 15, 2004, entitled "Cap for Electrical Connector".

U.S. Appl. No. 11/131,639, Dower et al, filed May 18, 2005, entitled Electrical Connector Assembly and Method of Forming the Same.

U.S. Appl. No. 11/131,874, Hills et al, filed May 18, 2005, entitled "Frame Assembly".

* cited by examiner

CIRCUIT MARKER APPARATUS

CROSS-REFERENCE TO RELATED APPLICATION(S)

The present application is a continuation-in-part of U.S. patent application Ser. No. 11/170,956, filed on Jun. 30, 2005 and entitled, "APPARATUS CONFIGURED TO ATTACH TO AN ELECTRICAL CONNECTOR BLOCK".

FIELD

The present invention relates to an apparatus for use in connection with an insulation displacement connector block ("connector block"). More particularly, the present invention relates to an apparatus that is configured to removably attach to an access cover of a connector block, where the apparatus includes an indicium, such as being color-coded, to visibly mark a circuit.

BACKGROUND

In a telecommunications context, connector blocks are connected to cables that feed subscribers while other connector blocks are connected to cables that are fed from a service provider center. To make the electrical connection between the subscriber block and the service provider block, an electrical conductor (e.g., a jumper wire) may be inserted in each connector block to complete the electrical circuit. Typically an electrical conductor ("conductor") can be connected, disconnected, and reconnected several times as the subscriber's needs change.

The basic components of a connector block typically include a plurality of housing assemblies, where each housing assembly includes a housing, an IDC element disposed within the housing, and an access cover connected to the housing. The IDC element is used to make an electrical connection with a conductor that is partially disposed within the housing in order to complete the electrical circuit between the subscriber block and service provider block. The IDC element displaces the insulation from a portion of the conductor when the conductor is inserted into a slot within the IDC element. An electrical contact is then made between the conductive surface of the IDC element and the conductive core of the electrical conductor.

The access cover is moveable between an open position and a closed position. In one type of connector block ("Type A"), a conductor is fed into a opening in an access cover, and as the access cover is moved from its open position to its closed position, the conductor moves into the respective housing and contacts the IDC element disposed in the housing. After electrical contact is made between the conductor and IDC element and the access cover is in a closed position, the conductor extends from the access cover. In a Type A connector block, a portion of the conductor disposed within the access cover moves therewith. If the access cover is opened, the electrical connection between the conductor and the IDC element will likely be disrupted because the conductor will no longer be in contact with the IDC element. A disrupted electrical connection between the IDC element and the conductor results in a disrupted electrical circuit (between the service provider and the subscriber), and therefore disrupted service for the subscriber.

In another type of connector block ("Type B"), a conductor is initially fed into an opening in the housing and then into an opening in an access cover (when the access cover is in its open position). As the access cover moves from its open position to its closed position, the portion of the conductor moving through the opening in the access cover is severed from the main part of the conductor. As a result, the conductor is no longer disposed within the opening in the access cover. After the access cover is in its closed position, the conductor contacts the IDC element disposed within the respective housing of the access cover and an electrical connection is made between the conductor and the IDC element. The conductor extends from the opening in the housing rather than the access cover, as in a Type A connector block. Because the conductor is no longer disposed with the access cover in a Type B connector block, the conductor will likely remain in contact with the IDC element if the access cover is moved into its open position after the electrical connection is made.

In both types of connector blocks, the IDC element within the housing of the connector block is accessible when the access cover is in its open position. When the access cover is in its open position, the IDC element is vulnerable to environmental hazards, such as moisture. It is typically preferred that the access cover remain in a closed position after an electrical connection is made between the conductor and IDC element in order to protect the electrical connection from environmental hazards. Of course, the access cover may be opened for maintenance purposes. As demonstrated by the Type A connector block, it is also important that the access cover of each housing assembly of a connector block remain in a closed position after an electrical connection between a conductor and IDC element in order to help prevent the circuit from becoming disrupted.

When a connector block is used in the telecommunications context, a plurality of connector blocks are typically mounted in a central location, such as a telecommunications closet, an outdoor cabinet, an aerial terminal or closure, or other common use applications. Oftentimes, thousands of electrical circuits between the subscribers and service provider are completed in the central location. It may be important to mark a circuit, or a series of circuits, to distinguish the circuit from other circuits in the central location. For example, it may be important to mark circuits providing telecommunications services to a hospital or police station so that those circuits are easily identifiable.

BRIEF SUMMARY

In a first aspect, the present invention is a circuit marker configured to removably attach to an access cover of an insulation displacement connector block. The circuit marker includes a body adapted to attach to the access cover and means for attaching the body to the access cover. The means includes at least one projection extending from the body and is adapted to engage with a recess formed in the access cover. At least a part of the circuit marker bears a visual indicium.

In a second aspect, the present invention is an apparatus configured to removably attach to an access cover of an insulation displacement connector block, where the access cover includes a releasable securing mechanism for fixing the access cover in a closed position relative to a cavity within the connector block. The apparatus includes a body adapted to attach to the access cover and an appendage extending from the body. The appendage is configured to lock the access cover in its closed position.

In a third aspect, the present invention is an electrical connector assembly including a housing, an access cover connected to the housing, and a circuit marker removably attached to the access cover. The housing includes an insulation displacement connector element, wherein the insulation displacement connector element is adapted to electrically connect with a conductor partially disposed within the housing. The circuit marker includes a body adapted to attach to the access cover and means for attaching the body to the access cover, wherein the means includes at least one projection extending from the body and is adapted to engage with a recess formed in the access cover. At least a part of the circuit marker bears a visual indicium.

The above summary is not intended to describe each disclosed embodiment or every implementation of the present invention. The figures and the detailed description which follow more particularly exemplify illustrative embodiments.

BRIEF DESCRIPTION OF THE DRAWINGS

The present invention will be further explained with reference to the drawing figures listed below, where like structure is referenced by like numerals throughout the several views.

Figure 1:
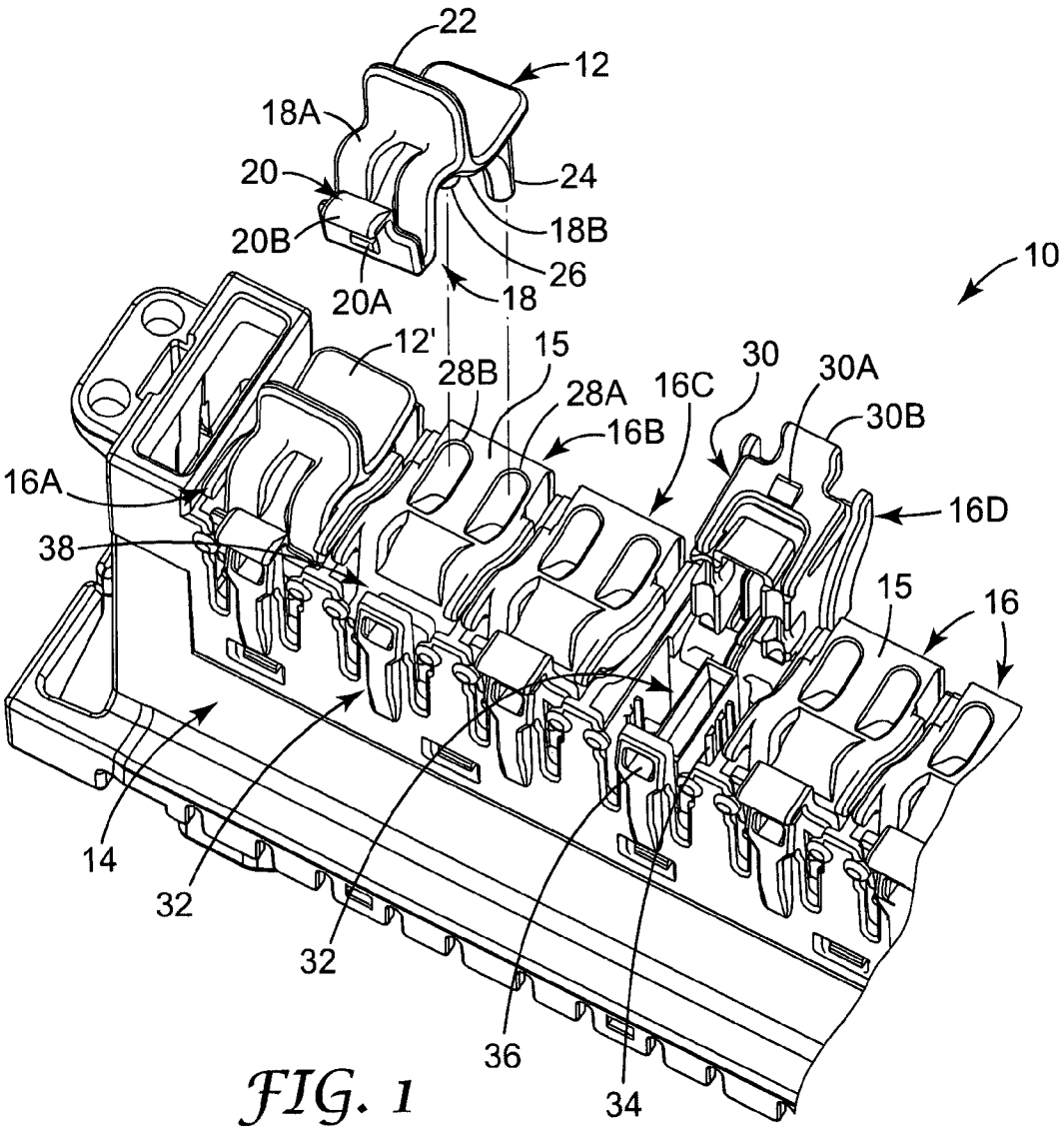
FIG. 1 is a partial exploded perspective view of a first exemplary embodiment of an electrical connector assembly of the present invention, which includes an electrical connector block including a plurality of access covers and two inventive circuit markers in accordance with a first exemplary embodiment, where one circuit marker 12' is attached to an access cover, and another circuit marker 12 is aligned to attach to an adjacent access cover.

While the above-identified figures set forth four exemplary embodiments of the present invention, other embodiments are also within the invention. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

The present invention is an apparatus that is configured to removably attach to an access cover of a connector block, where the apparatus includes at least one visual indicium to distinguish the circuit associated with the access cover from other circuits. In this way, the apparatus is a "circuit marker". The circuit marker may be detached and reattached to the access cover as needs change. The visual indicium may result from at least a part of the circuit marker being formed of a colored material, a color coating on at least a part of the circuit marker, or the circuit marker may otherwise include a colored material (e.g., a sticker), where the color corresponds to a color-coding scheme that is implemented to distinguish between circuits formed by electrical connector blocks. For example, a circuit marker may be formed of a red, yellow, brown, or purple material, where each color designates a different type of circuit. Red may be used to mark circuits providing telecommunications service to a fire department, police station, and/or alarm companies; yellow may be used to mark circuits feeding banks; brown may be used to mark circuits feeding hospitals; and purple may be used to mark digital subscriber line (DSL) circuits. Other visual indicium may also be used.

A circuit marker of the present invention includes a body and a means for attaching the circuit marker to an access cover, where the means projects from the body. In an exemplary embodiment described below, the attaching means includes locating pins and appendages that engage with recesses formed in the access cover. In general, the attaching means depends upon the type of access cover the circuit marker is intended to attach to. For example, in embodiments where the circuit marker includes a releasable securing mechanism for securing the access cover in a closed position, the structure of the circuit marker is modified in order to adapt to the type of securing mechanism. In some embodiments, an adhesive is used in conjunction with the attaching means to secure the circuit marker to the access cover.

A circuit marker may be a unitary apparatus, where the body and means for attaching the circuit marker to an access cover are formed of a single piece of material. The inventive circuit marker may be formed of any suitable materials, including, but not limited to, polycarbonate, polypropylene, polyester, or polyethylene. Four exemplary embodiments of the present invention are described below in reference to FIGS. 1-7. In all the exemplary embodiments, a circuit marker is configured so that when it is attached to an access cover, the circuit marker is in close conforming contact with at least part of the top surface of the access cover. Also in the exemplary embodiment, the circuit marker attaches to the access cover without the use of any further attaching means, such as an adhesive. In alternate embodiments, further attaching means may be used to attach the circuit marker to the access cover.

In a first exemplary embodiment of the present invention, the apparatus is configured to form at least a part of a releasable securing mechanism for securing an access cover in a first position (e.g., a closed position), where the securing mechanism may be released to move the access cover between the first position and a second position (e.g., an open position). This first exemplary embodiment is shown in FIG. 1. In a second exemplary embodiment (FIGS. 2A-3) of the present invention, a circuit marker removably attaches to an access cover with locating pins, which also help to align the circuit marker with the access cover. The locating pins fit within corresponding recesses in the access cover.

In a third exemplary embodiment (FIGS. 4A-5), the circuit marker removably attaches to an access cover with locating pins and an appendage, both of which fit within separate recesses in the access cover. In the second and third embodiments, the access cover includes a releasable securing mechanism for securing itself in a first position, and the circuit marker does not significantly affect the operation of the securing mechanism. In a fourth exemplary embodiment (FIGS. 6A-7) of the present invention, an inventive circuit marker also includes locating pins and an appendage. However, the circuit marker is configured to inhibit the operation of at least a part of a securing mechanism of an access cover, thereby maintaining the access cover in a fixed position (i.e., remained locked in a closed position) when the circuit marker is attached to the access cover.

Typically, at least one circuit between a subscriber cable and service provider cable is completed in each housing assembly (e.g., housing 32 and access cover 16 of FIG. 1) of connector block (e.g., connector block 14 of FIG. 1). As a result, one access cover corresponds to at least one circuit. In a telecommunications context, a connector block, such as connector block 14 of FIG. 1, is typically mounted alongside a plurality of other connector blocks in a central location. Because a plurality of circuits are formed in the central location, it may be important to have a means for readily distinguishing some circuits from others.

A circuit marker that is attached to an access cover helps to distinguish the circuit that is associated with that access cover from other circuits. As stated in the Background section, a connector block typically includes a plurality of housing assemblies, where each housing assembly includes a housing, an IDC element disposed within the housing, and an access cover connected to the housing. Each IDC element in each housing assembly may be used to complete at least one circuit between a subscriber cable and service provider cable. As a result, one access cover corresponds to at least one circuit.

A telecommunications worker is typically given access to the central location in order to connect and disconnect conductors completing the circuits between a subscriber cable and service provider cable. If the special circuits are marked, the telecommunications worker may be put on notice that those circuits are special. For example, a circuit that provides a police station or a hospital with telecommunications service may be designated as a special, higher priority circuit. The marking may also help organize the circuits completed in the central location, such as by grouping the circuits by color. In this way, the inventive circuit marker of the present invention may be used to mark circuits formed by a connector block.

FIG. 1 is a partial exploded perspective view of a first exemplary embodiment of electrical connector assembly 10 of the present invention, which includes two inventive circuit markers 12 and 12' in accordance with a first exemplary embodiment, and electrical connector block 14. Exemplary connector block 14 is a Type B connector block (as described in the Background section), and includes a plurality of access covers 16 (including access covers 16A, 16B, 16C, and 16D). FIG. 1 illustrates how circuit marker 12 aligns with and attaches to access cover 16B of connector block 14. Circuit marker 12' is attached to access cover 16A.

Circuit marker 12 (and 12') includes body 18, appendage 20, gripping tab 22, and locating pins 24 and 26. Circuit marker 12 is further described in U.S. patent application Ser. No. 11/170,956, filed on Jun. 30, 2005 and entitled, "APPARATUS CONFIGURED TO ATTACH TO AN ELECTRICAL CONNECTOR BLOCK". In the first exemplary embodiment, circuit marker 12 is a unitary apparatus, where the body 18, appendage 20, gripping tab 22, and locating pins 24 and 26 are formed from a single piece of material. In accordance with the present invention, circuit marker 12 includes a visual indicium of a circuit. In the first exemplary embodiment, circuit marker 12 is formed of a colored material, where a color of the material corresponds to a color-coding scheme. The color-coding scheme may be implemented by, for example, a specific industry or company. Other examples of visual indicium include, but are not limited to, a colored or otherwise labeled sticker attached to gripping tab 22 or a coating of colored material overlaid on body 18 and/or gripping tab 22.

Body 18 includes first surface 18A and second surface 18B, where first and second surfaces 18A and 18B, respectively, are located on opposite sides of body 18. A contour of second surface 18B of circuit marker 12 is similar to a contour of a top surface 15 of each one of the plurality of access covers 16. As a result, at least a part of second surface 18B is in close conforming contact with the top surface 15 of an access cover 16 of electrical connector block 14 when circuit marker 12 is attached thereto.

Appendage 20 extends from body 18 and includes latching member 20A and release member 20B. Latching member 20A and release member 20B will be discussed in further detail below. Gripping tab 22 extends from first surface 18A of body 18, and may be used by a telecommunications worker to both attach circuit marker 12 to access cover 16B and remove circuit marker 12 from the access cover 16B. Specifically, the telecommunications worker may grasp gripping tab 22 with his fingers or a tool, such as pliers. Locating pins 24 and 26 extend from second surface 18B of body 18, and are used to align circuit marker 12 with an access cover 16B. In this way, circuit marker 12 is "self-aligning". Although two locating pins 24 and 26 are shown in FIG. 1, a circuit marker of the present invention may have any suitable number of locating pins.

An access cover 16 is connected to a housing 32, and together each access cover 16 and its respective housing 32 form a housing assembly. An IDC element 34 is disposed within each housing 32. Each IDC element 34 is adapted to electrically connect with a conductor that is introduced into the respective housing 32. The electrical connection between IDC element 34 and conductor completes an electrical circuit between a subscriber block and a service provider block. As FIG. 1 shows, each housing 32 and respective IDC element 34 is accessible when the access cover is in an open position (e.g., access cover 16D).

Access covers 16A, 16B, 16C, and 16D of connector block 14 are each substantially similar in structure and are each moveable between an open position (e.g., access cover 16D) and a closed position (e.g., access cover 16C). In the illustrated embodiment, each access cover 16A, 16C, and 16D includes two recesses (e.g., recesses 28A and 28B of access cover 16B) for receiving a conductor and a latching mechanism (e.g., latching mechanism 30 of access cover 16D), which will be discussed in detail below. Access cover 16B includes two recesses 28A and 28B, but its latching mechanism has been removed.

The description of the structure of access cover 16D is representative of each of the access covers 16. Access cover 16D includes latching mechanism 30 to secure access cover 16D in its closed position relative to housing 32. As described in the Background section, it is sometimes desirable to secure access cover 16D in its closed position. Latching mechanism 30 includes latching member 30A and release member 30B. Latching member 30A protrudes from access cover 16D and is configured to engage with a surface within opening 36 in housing 32 of connector block 14. Release member 30B is resilient, and attached to body access cover 16D so that release member 30B is biased towards opening 36. Release member 30B may be flexed away from opening 36 in order to disengage latching ember 30A from the surface within opening 36. Disengaging latching member 30A from he surface within opening 36 enables access cover 16D to be moved from its closed position to its open position.

At some point during the lifespan of connector block 14, latching mechanism 30 may become dysfunctional. For example, latching member 30A may wear down over time after repeated opening and closing of access cover 16D. If latching member 30A wears down, it may not protrude sufficiently from access cover 16D to engage with the surface within opening 36 to secure access cover 16D in a closed position. Latching mechanism 30 may also become dysfunctional if releasing member 30B is separated from (i.e., broken off from) access cover 16D or if the entire latching mechanism 30 is separated from access cover 16D.

Rather than discontinuing use of the respective housing 32 or replacing access cover 16D or connector block 14 due to a damaged latching mechanism 30, circuit marker 12 may be attached to access cover 16D to take the place and function of latching mechanism 30, just as circuit marker 12' is attached to access cover 16A. Circuit marker 12 may attach to access cover 16D just as it attaches to 16B. Specifically, circuit marker 12 is configured to attach to access cover 16B using locating pins 24 and 26, which are received in and engage with recesses 28A and 28B, respectively, and appendage 20, which is received in and engages with vacancy 38 between access cover 16B and housing 32 of connector block 14. In the first exemplary embodiment, as locating pins 24 and 26 are received in recesses 28A and 28B, respectively, locating pins 24 and 26 help to align circuit marker 12 with access cover 16B. Locating pins 24 and 26 also provide a means for fixing the position of circuit marker 12 with respect to access cover 26B. That is, once locating pins 24 and 26 are received in recesses 28A and 28B, respectively, circuit marker 12 will not be inclined to reorient itself with respect to access cover 16B. In alternate embodiments, other suitable means of locating a circuit marker with respect to the access cover are used. In yet other alternate embodiments, a circuit marker is not self-aligning and is aligned by a telecommunications worker.

Circuit marker 12 includes a latching mechanism (appendage 20 with latching member 20A and release member 20B) that is configured to replace the damaged or missing latching mechanism 30 of access cover 16B. Latching mechanism 30 has been removed from access cover 16B, and so access cover 16B does not have a securing mechanism to secure access cover 16B in a closed position relative to its respective housing 32. After circuit marker 12 is attached to access cover 16B, however, latching mechanism 20A of circuit marker 12 may be used to secure access cover 16B in a closed position relative to housing 32. Latching member 20A of circuit marker 12 is configured (or "adapted") to engage with a surface within opening 36 of housing 32, and therefore be "received" in the opening. Latching member 20A is in a latched position when it is received in opening 36 of housing 32, and when latching member 20A is in the latched position, the access cover 16B is fixed in a closed position.

If just latching mechanism 30A becomes worn, latching mechanism 30 may be purposefully broken off to make room for circuit marker 12 to attach to the access cover 16. In this way, a circuit marker of the present invention may be used to replace a latching mechanism of an access cover. If an access cover includes a securing mechanism other than a latching mechanism, the concepts of the exemplary embodiment may be applied to form a circuit marker that is configured to replace a part or all of such a securing mechanism.

In FIG. 1, circuit marker 12' has already been attached to access cover 16A, and represents how circuit marker 12 attaches to access cover 16B and can be used to latch access cover 16B in its closed position relative to its respective housing 32. With respect to access cover 16A, circuit marker 12' replaces a latching member 30 of access cover 16A, which has been separated from access cover 16A. When access cover 16A is in a closed position, as shown in FIG. 1, latching member 20A of circuit marker 12' engages with a surface within opening 36 and is resiliently biased against the surface by appendage 20 of circuit marker 12'. This secures access cover 16A in a closed position. In order to move access cover 16A from its closed position to its open position, release member 20B is flexed away from opening 36 to disengage latching member 20A from the surface within opening 36. Access cover 16A may then be moved from its closed position to its open position (e.g., access cover 16).

Figure 2B:
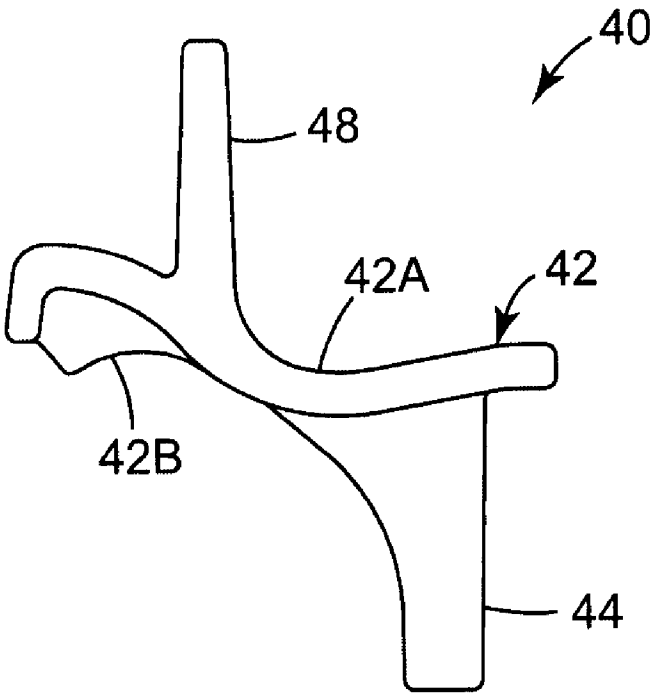
FIG. 2B is a side view of the circuit marker of FIG. 2A.
Figure 2A:
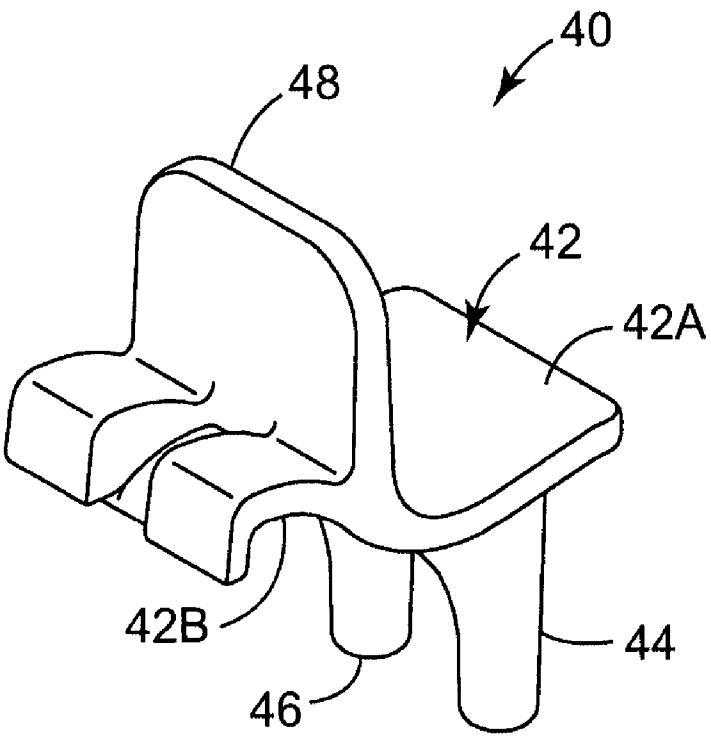
FIG. 2A is a perspective view of a second exemplary embodiment of a circuit marker 40 of the present invention.

FIG. 2A is a perspective view of the second exemplary embodiment of a circuit marker 40 of the present invention. Circuit marker 40 includes body 42, locating pins 44 and 46, and gripping tab 48. In the second exemplary embodiment, circuit marker 40 is a unitary apparatus, where the body 42, locating pins 44 and 46, and gripping tab 48 are formed from a single piece of material. Body 42 includes first surface 42A and second surface 42B, where first and second surfaces 42A and 42B, respectively, are located on opposite sides of body 42.

Locating pins 44 and 46 extend from second surface 42B of body 42, and gripping tab 48 extends from first surface 42A of body 42. Locating pins 44 and 46 and gripping tab 48 are similar to locating pins 24 and 26 and gripping tab 22 of circuit marker 12 of FIG. 1. Circuit marker 40 differs from circuit marker 12 of FIG. 1 because circuit marker 40 does not include a releasable securing mechanism (e.g., appendage 20) for securing an access cover in a closed position. Rather, circuit marker 40 is configured to removably attach to an access cover that already includes a releasable securing mechanism. Circuit marker 40 does not substantially affect the operation of the releasable securing mechanism of the access cover. Circuit marker 40 may be attached on an access cover to provide a visual indicium of a circuit, and thereby visibly mark the circuit.

FIG. 2B is a side view of the circuit marker of FIG. 2A and illustrates the contour of second surface 42B of body 42. Second surface 42B is configured so that at least part of second surface 42B is in close conforming contact with a top surface 15 of the access cover 16 (shown in FIG. 3) when circuit marker 42 is attached to the access cover 16. Specifically, in the second exemplary embodiment, second surface 42B has a similar contour to the top surface 15 of the access cover 16.

Figure 3:
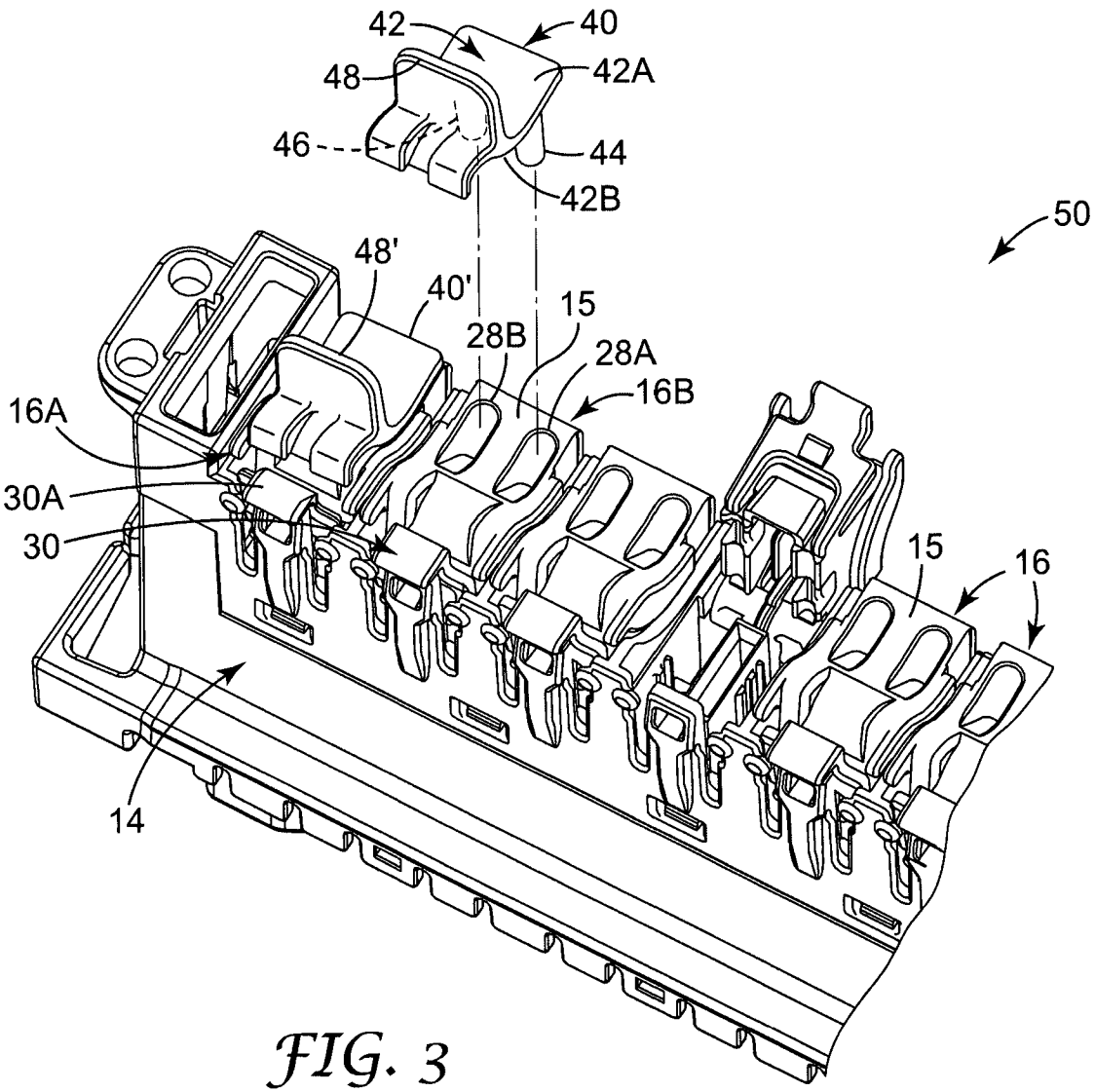
FIG. 3 is a partial exploded perspective view of a second exemplary embodiment of an electrical connector assembly of the present invention, which includes an electrical connector block including a plurality of access covers and two inventive circuit markers in accordance with the second exemplary embodiment, where one circuit marker 40' is attached to an access cover, and another circuit marker 40 is aligned to attach to an adjacent access cover.

FIG. 3 is a partial exploded perspective view of a second exemplary embodiment of electrical connector assembly 50 of the present invention, where electrical connector block 14 of FIG. 1 now includes second exemplary embodiment of circuit marker 40' attached to access cover 16A and circuit marker 40 aligned to attach to adjacent access cover 16B. Access cover 16B now includes releasable securing mechanism 30 for securing access cover 16B in a closed position. While circuit marker 40 may be attached to access cover 16B of FIG. 1, which does not include a releasable securing mechanism 30, it may not be desirable to do so because there would be no means for securing access cover 16B in a closed position. In a situation where access cover 16B does not include securing mechanism 30, first exemplary embodiment of circuit marker 12 is preferably attached to access cover 16B (as shown in FIG. 1).

As FIG. 3 shows, locating pin 44 of circuit marker 40 is aligned to be received in and engage with recess 28A of access cover 16B. Similarly, locating pin 46 (shown in phantom) is aligned to be received in and engage with recess 28B of access cover 16B. In this way, locating pins 44 and 46 are a means for attaching circuit marker 40 to access cover 16B.

Circuit marker 40' is removably attached to access cover 16A. A telecommunications worker may remove circuit marker 40' from access cover 16A by grasping gripping tab 48', for example, with his fingers or a tool. Because circuit marker 40' does not include an appendage (e.g., appendage 20 of circuit marker 12) extending from body 42, circuit marker 40' does not substantially interfere with the operation of releasable securing mechanism 30. Rather, circuit marker 40' provides a visual indicium of a circuit, and thereby visibly marks the circuit associated with access cover 16A. Just as with circuit marker 12, the visual indicium may be established with at least body 42 and/or gripping tab 48 formed of a colored material, a colored or otherwise labeled sticker attached to gripping tab 48, or a coating of colored material overlaid on body 42 and/or gripping tab 48.

Figure 4B:
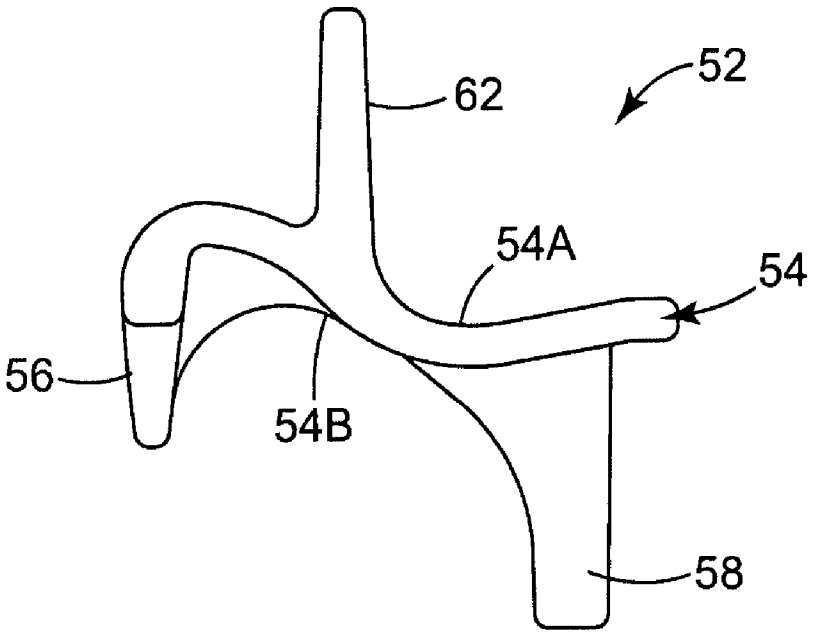
FIG. 4B is a side view of the circuit marker of FIG. 4A.
Figure 4A:
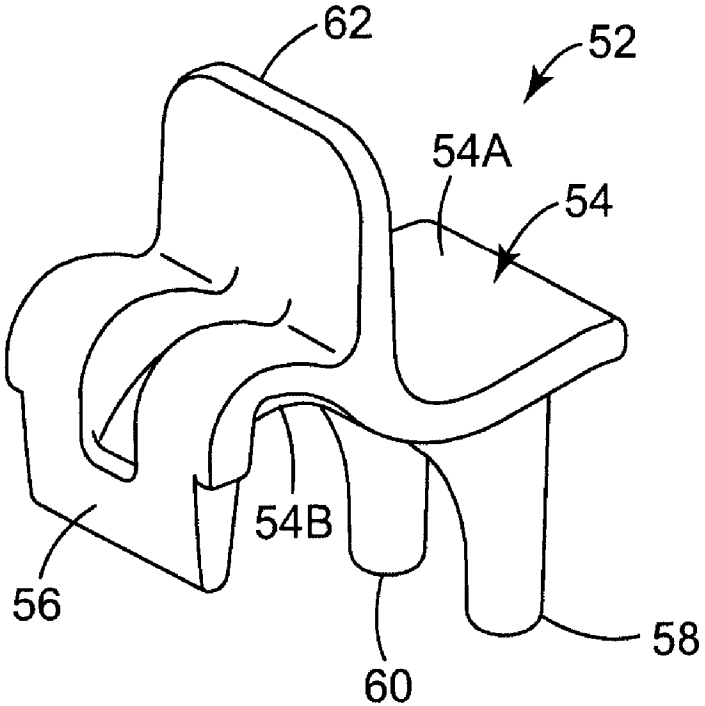
FIG. 4A is a perspective view of a third exemplary embodiment of a circuit marker 52 of the present invention.

FIG. 4A is a perspective view of the third exemplary embodiment of a circuit marker 52 of the present invention. Circuit marker 52 includes body 54, appendage 56, locating pins 58 and 60, and gripping tab 62. In the third exemplary embodiment, circuit marker 52 is a unitary apparatus, where body 54, appendage 56, locating pins 58 and 60, and gripping tab 62 are formed from a single piece of material. Body 54 includes first surface 54A and second surface 54B, where first and second surfaces 54A and 54B, respectively, are located on opposite sides of body 54.

Appendage 56 is a wedge-shaped projection (or "extension") that projects from body 54. Locating pins 58 and 60 extend from second surface 54B of body 54, and gripping tab 62 extends from first surface 54A of body 54. Locating pins 58 and 60 and gripping tab 62 are similar to locating pins 24 and 26 and gripping tab 22 of circuit marker 12 of FIG. 1.

Just as with circuit marker 40, circuit marker 52 differs from circuit marker 12 of FIG. 1 because circuit marker 52 does not include a releasable securing mechanism (e.g., appendage 20) for securing an access cover in a closed position. Rather, circuit marker 52 is configured to removably attach to an access cover that already includes a releasable securing mechanism. Circuit marker 52 does not substantially affect the operation of the releasable securing mechanism of the access cover. This will be described in further detail in reference to FIG. 5. Circuit marker 52 may be attached to an access cover to provide a visual indicium of a circuit, and thereby visibly mark the circuit.

FIG. 4B is a side view of the circuit marker of FIG. 4A and illustrates the contour of second surface 54B of body 54. Second surface 54B is configured so that at least part of second surface 54B is in close conforming contact with a top surface 15 of the access cover 16 (shown in FIG. 5) when cap 52 is attached to the access cover 16. Specifically, in the third exemplary embodiment, second surface 54B has a similar contour to the top surface 15 of the access cover 16.

Figure 5:
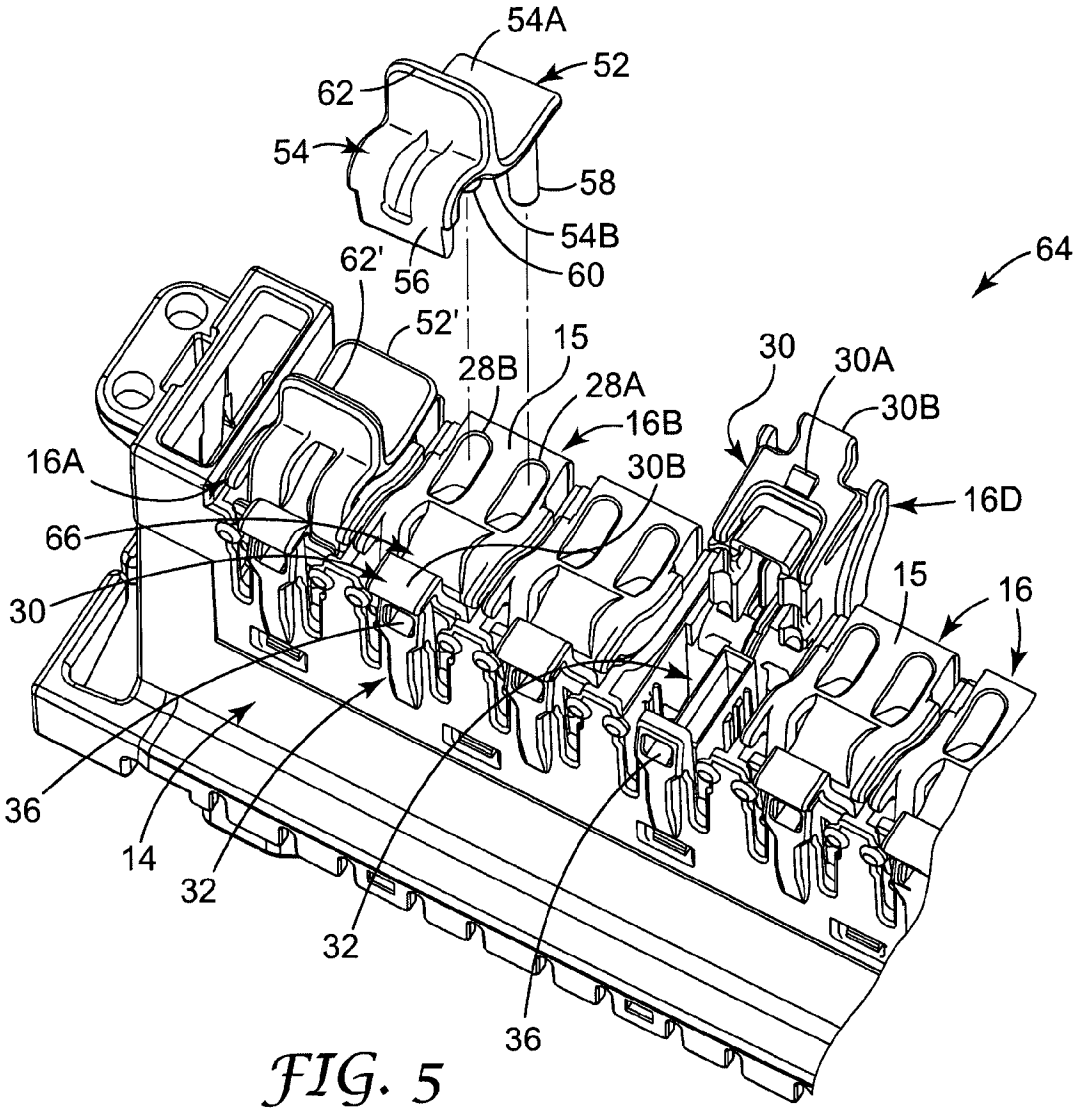
FIG. 5 is a partial exploded perspective view of a third exemplary embodiment of an electrical connector assembly of the present invention, which includes an electrical connector block including a plurality of access covers and two inventive circuit markers in accordance with the third exemplary embodiment, where one circuit marker 52' is attached to an access cover, and another circuit marker 52 is aligned to attach to an adjacent access cover.

FIG. 5 is a partial exploded perspective view of a third exemplary embodiment of electrical connector assembly 64 of the present invention, where electrical connector block 14 of FIG. 1 now includes second exemplary embodiment of circuit marker 52' attached to access cover 16A and circuit marker 52 aligned to attach to adjacent access cover 16B. Access cover 16B now includes releasable securing mechanism 30 for securing access cover 16B in a closed position. Just as with circuit marker 40 of FIGS. 2A-3, it is preferred that circuit marker 52 is attached to an access cover 16 that includes a releasable securing mechanism (e.g., latching mechanism 30).

As FIG. 5 shows, locating pin 58 of circuit marker 52 is aligned to be received in and engage with recess 28A of access cover 16B. Similarly, locating pin 60 is aligned to be received in and engage with recess 28B of access cover 16B. In this way, locating pins 58 and 60 are a means for attaching circuit marker 52 to access cover 16B. Appendage 56 is configured to be received in recess 66 in an access cover 16B, and as a result, appendage is also a means for attaching circuit marker 52 to access cover 16B. Appendage 56 is not of sufficient thickness of interfere with the movement of release member 30B of latching mechanism 30 of access cover 16B. Even with circuit marker 52 attached to access cover 16B, release member 30B has sufficient clearance to flex away from opening 36 in housing 32 to disengage latching member 30A from a surface within opening 36, thereby allowing access cover 16B to be moved from its closed position to its open position.

Circuit marker 52' is removably attached to access cover 16A. A telecommunications worker may remove circuit marker 52' from access cover 16A by grasping gripping tab 62', for example, with his fingers or a tool. Just as with the previous two exemplary embodiments, circuit marker 52' provides a visual indicium of a circuit, and thereby visibly marks the circuit associated with access cover 16A. The visual indicium may be established with at least body 54 and/or gripping tab 62 formed of a colored material, a colored sticker attached to gripping tab 62, or a coating of colored material overlaid on body 54 and/or gripping tab 62.

Figure 6B:
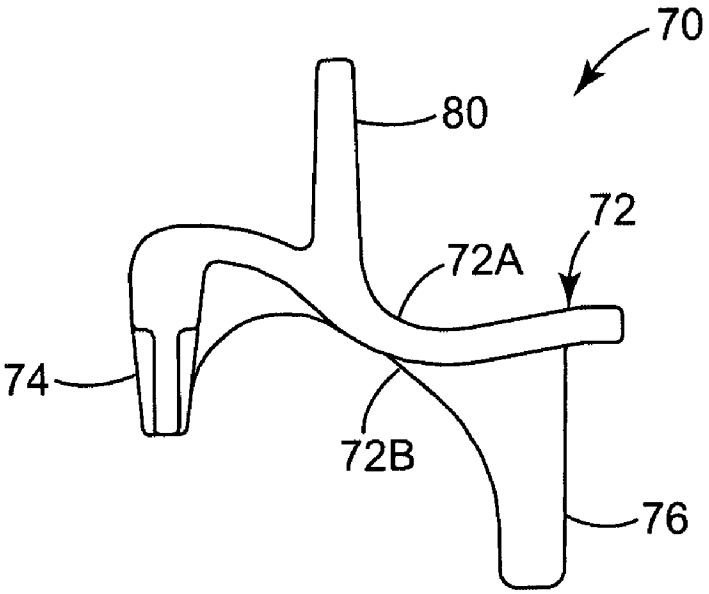
FIG. 6B is a side view of the circuit marker of FIG. 6A.
Figure 6A:
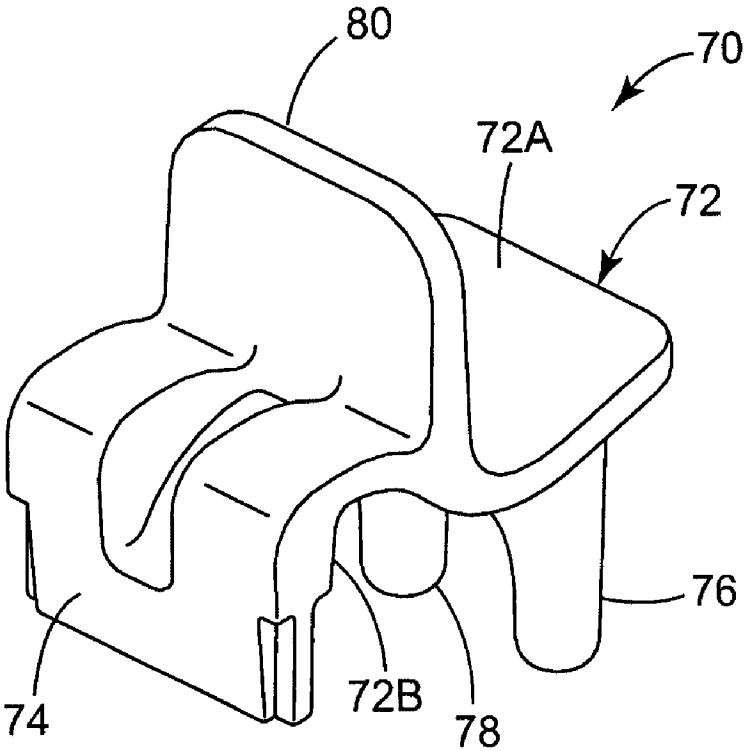
FIG. 6A is a perspective view of a fourth exemplary embodiment of a circuit marker 70 of the present invention.

FIG. 6A shows a perspective view of a fourth exemplary embodiment of inventive circuit marker 70, which includes body 72, appendage 74, locating pins 76 and 78 (shown in phantom), and gripping tab 80. The fourth exemplary embodiment of circuit marker 70 of the present invention decreases the possibility that an access cover will be inadvertently opened, such as by a telecommunications worker or otherwise, by inhibiting the operation of a securing mechanism (e.g., latching mechanism 30 of access cover 16 in FIG. 7) of the access cover. As noted above, it may be desirable for an access cover to remain in a closed position after a conductor is electrically connected to the IDC element (e.g., IDC element 34 in FIG. 1) in the respective housing of the access cover. The closed position helps to ensure the conductor remains in electrical contact with the IDC element and/or helps prevent environmental hazards from being introduced into the housing of the connector block. An inventive circuit marker 70 of the present invention provides an attachable means for substantially locking the access cover in its closed position. Of course, the circuit marker may be detached from the access cover in order to allow the access cover to moved from its closed position to its open position.

FIG. 6B is a side view of circuit marker 70 of FIG. 6A and illustrates the contour of second surface 72B of body 72. Second surface 72B is configured so that at least part of second surface 72B is in close conforming contact with a top surface 15 of the access cover 16 (shown in FIG. 7) when circuit marker 70 is attached to the access cover 16. Specifically, in the fourth exemplary embodiment, second surface 72B has a similar contour to the top surface 15 of the access cover 16.

Figure 7:
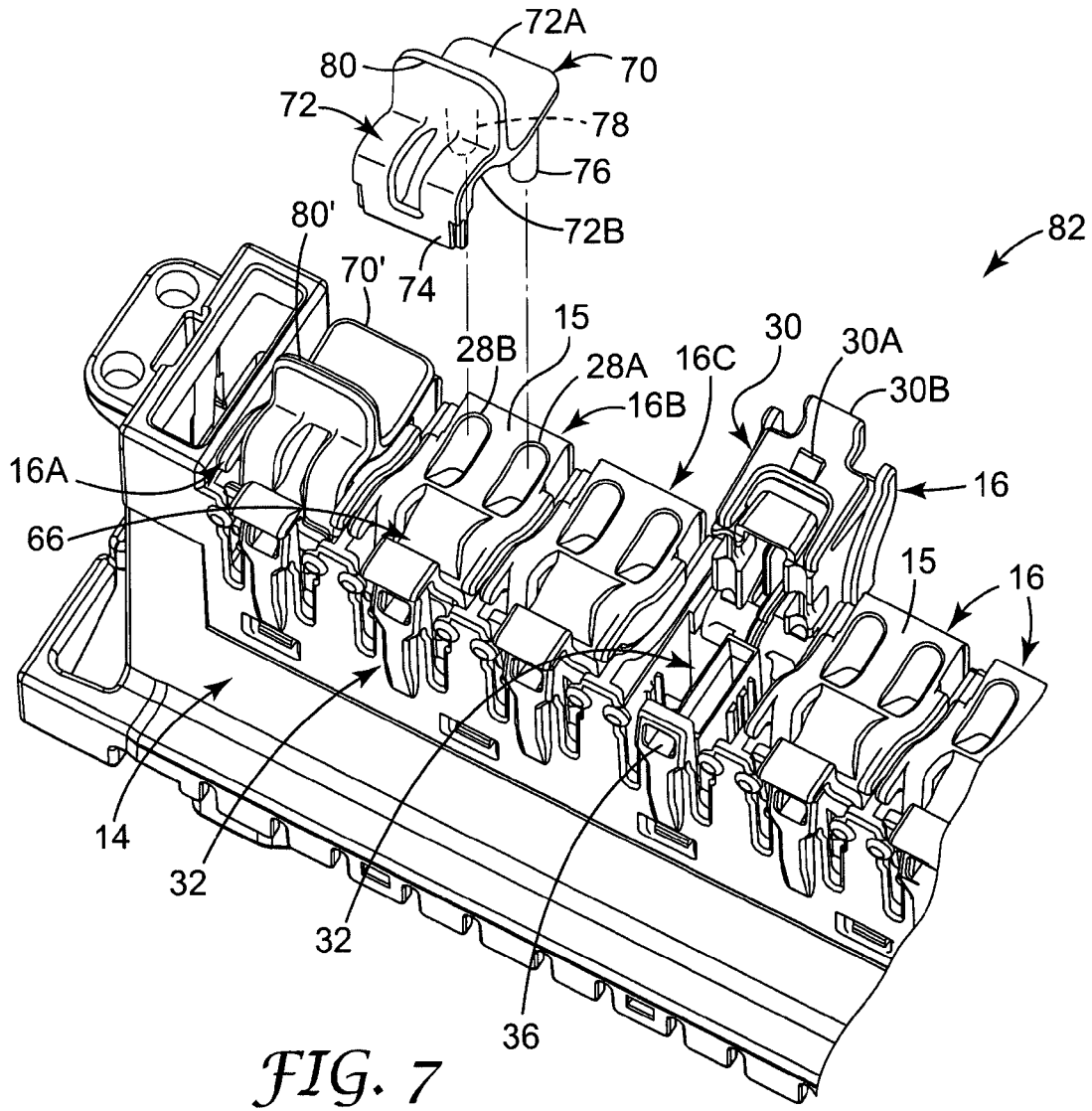
FIG. 7 is a partial exploded perspective view of a fourth exemplary embodiment of an electrical connector assembly of the present invention, which includes an electrical connector block including a plurality of access covers and two inventive circuit markers in accordance with the fourth exemplary embodiment, where one circuit marker 70' is attached to an access cover, and another circuit marker 70 is aligned to attach to an adjacent access cover.

FIG. 7 is a partially exploded assembly view of fourth exemplary embodiment of electrical connector assembly 82 of the present invention, where electrical connector assembly 82 includes circuit markers 70 and 70' and connector block 14. Circuit marker 70' is attached to access cover 16A and circuit marker 70 is aligned to attach to adjacent access cover 16B. Access cover 16B includes releasable securing mechanism 30 (shown with respect to access cover 16D) for securing access cover 16B in a closed position (e.g., access cover 16C is in a closed position). As with the second and third exemplary embodiments, it is preferred that circuit marker 70 is attached to an access cover 16 that includes a releasable securing mechanism.

As FIG. 7 shows, locating pin 76 of circuit marker 70 is aligned with recess 28A of access cover 16B, and configured to be received therein. Similarly, locating pin 78 (shown in phantom) is aligned with recess 28B of access cover 16B. In this way, locating pins 76 and 78 are a means for attaching circuit marker 70 to access cover 16B. Appendage 74 is configured to be received in and engage with recess 66 in an access cover 16B, and as a result, appendage 74 is also a means for attaching circuit marker 70 to access cover 16B. Appendage 74 is of greater thickness than appendage 56 of circuit marker 52 of FIG. 5. While appendage 56 is not of sufficient thickness of interfere with the movement of release member 30B of latching mechanism 30 of access cover 16B, appendage 74 is thick enough to interfere with the movement of release member 30B. Even if release member 30B has clearance to flex away from opening 36 in housing 32, such clearance is not sufficient enough to disengage latching member 30A from the surface within opening 36. As a result, when circuit marker 70 is attached to access cover 16B, and access cover 16B is in its closed position, latching mechanism 30 is substantially locked. As a result, access cover 16B remains locked in a closed position.

If the access cover 16 is in its closed position (e.g., access cover 16C) when circuit marker 70 is attached to the access cover 16, latching member 30A of the latching mechanism 30 is engaged with opening 36 in housing 32 of connector block 14. When the inventive circuit marker 70 is attached to the access cover 16, a "wedge" is positioned behind release member 30B, so that movement of release member 30B is restricted. Release member 30B may not be flexed away from opening 36 in housing 32 a sufficient distance to disengage latching member 30A from opening 36. As a result, the access cover 16 is substantially "locked" in its closed position.

Circuit marker 70 is a unitary apparatus, where body 72, appendage 74, locating pins 76 and 78 (shown in phantom), and gripping tab 80 are formed from a single piece of material. Body 72 includes first surface 72A and second surface 72B, where first and second surfaces 72A and 72B, respectively, are located on opposite sides of body 72.

Appendage 74 extends from body 72 and is a generally wedge-like shape. In other embodiments, appendage 74 is a different shape. The shape of appendage 74 is selected based on the securing mechanism that is used to secure the access cover in a closed position. As FIG. 7 will show, when circuit marker 70 is attached to an access cover 16 (shown in FIG. 7), generally wedge-like shape of appendage 74 fits within a recess in access cover 66 and in close conforming contact with release member 30B of securing mechanism 30 of access cover 16. Due to the close conforming contact, appendage 74 restricts the movement of release member 30B and helps to prevent release member 30B from flexing away from opening 36 in housing 32 a distance sufficient to disengage latching member 30A from opening 36. In this way, appendage 74 limits operation of releasable securing mechanism 30, and helps to substantially "lock" access cover 16 in a closed position, relative to housing 32.

Locating pins 76 and 78 and gripping tab 80 are similar to locating pins 24 and 26 and gripping tab 22 of circuit marker 12 of FIG. 1. Locating pins 76 and 78 (shown in phantom) extend from second surface 72B of body 72, and help to align circuit marker 70 with an access cover. Gripping tab 80 extends from first surface 72A of body 72, and may be used by a telecommunications worker to both attach circuit marker 70 to an access cover and remove circuit marker 70 from the access cover. Specifically, the telecommunications worker may grasp gripping tab 80 with his fingers or a tool, such as pliers.

Circuit marker 70' is removably attached to access cover 16A. A telecommunications worker may remove circuit marker 70' from access cover 16A by grasping gripping tab 80', for example, with his fingers or a tool. Just as with the previous two exemplary embodiments, circuit marker 70' provides a visual indicium of a circuit, and thereby visibly mark the circuit associated with access cover 16A. The visual indicium may be established with at least body 72 and/or gripping tab 80 formed of a colored material, a colored sticker attached to gripping tab 80, or a coating of colored material overlaid on body 72 and/or gripping tab 80.

The combination of the visual indicium and locking feature of circuit marker 70 provides a high priority circuit with two-fold protection against the access cover being unintentionally opened. First, the telecommunications worker is put on visual notice that the circuit associated with the access cover is a high priority circuit. Second, the locking feature of circuit marker 70 provides an additional step a telecommunications worker must take in order to open the high priority access cover. Further, the locking feature of circuit marker 70 helps to prevent the access cover from being inadvertently opened.

Connector block 14 of FIGS. 1, 3, 5, and 7 is a general depiction of an electrical connector block 14, and the depiction and description of connector block 14 is not intended to limit the present invention in any way. An apparatus of the present invention may also be used to mark circuits of other suitable connector blocks, including, but not limited to, both Type A and Type B connector blocks (as described in the Background section). Of course, aspects of the apparatus may change, depending on the structure of the connector block. For example, if the connector block does not have conductor-receiving recesses (e.g., recesses 28A and 28B shown in FIG. 1), locating pins of the apparatus may be modified to adapt to the access cover of the particular connector block.

Examples of suitable connector blocks that an inventive apparatus of the present invention may be attached to are described in U.S. patent application Ser. No. 10/941,506, entitled, "INSULATION-DISPLACEMENT SYSTEM FOR TWO ELECTRICAL CONNECTORS", and filed on Sep. 15, 2004, U.S. Patent Application Publication No. US 2006/0057884, entitled, "CONNECTOR ASSEMBLY FOR HOUSING INSULATION DISPLACEMENT ELEMENTS", and filed on Sep. 15, 2004, U.S. Pat. No. 6,406,324, issued on Jun. 18, 2002 and entitled, "INSULATION DISPLACEMENT CONNECTOR TERMINAL BLOCK", and U.S. Pat. No. 6,254,421, issued on Jul. 3, 2001 and entitled, "CONNECTOR ASSEMBLY HAVING PIVOTING WIRE CARRIER WITH POSITION DETENTS".

Although the present invention has been described with reference to preferred embodiments, workers skilled in the art will recognize that changes may be made in form and detail without departing from the spirit and scope of the invention.

The invention claimed is:

1. A circuit marker configured to removably attach to an access cover of an insulation displacement connector block, the circuit marker comprising:

a body adapted to attach to the access cover; and means for attaching the body to the access cover, wherein the means includes at least one projection extending from the body and is adapted to engage with a recess formed in the access cover, wherein at least a part of the circuit marker bears a visual indicium;

wherein the access cover includes a releasable securing mechanism capable of fixing the access cover in a closed position relative to a cavity within the connector block; and wherein the circuit marker is configured to limit operation of a releasable securing mechanism of the access cover.

2. The circuit marker of claim 1, wherein the body and means for attaching the body to the access cover are a unitary unit.

3. The circuit marker of claim 1, wherein the means for attaching the body to the access cover comprises a locating pin.

4. The circuit marker of claim 1, and further comprising a gripping tab extending from the body.

5. The circuit marker of claim 1, wherein the circuit marker is formed of a material selected from a group consisting of polycarbonate, polypropylene, polyester, and polyethylene.

6. The circuit marker of claim 1, wherein the visual indicium is a colored material, a color of the material corresponding to a color-coding scheme.

7. The circuit marker of claim 6, wherein at least a part of the circuit marker is formed of the colored material.

8. The circuit marker of claim 6, wherein the colored material is selected from a group of materials consisting of a red material, a yellow material, a brown material, and a purple material.

9. The circuit marker of claim 1, wherein the releasable securing mechanism is a latching mechanism comprising:

a latching member; and a release member moveable between a latched position and a release position with respect to the connector block, wherein in the latched position, the access cover is fixed in the closed position, and wherein the means for attaching the body to the access cover restricts movement of the release member from its latched position to its release position.

10. The circuit marker of claim 9, wherein the circuit marker comprises a wedge configured to limit movement of the release member.

11. A circuit marker configured to removably attach to an access cover of an insulation displacement connector block, the circuit marker comprising:

a body adapted to attach to the access cover;

means for attaching the body to the access cover, wherein the means includes at least one projection extending from the body and is adapted to engage with a recess formed in the access cover; and a gripping tab extending from the body;

wherein at least a part of the circuit marker bears a visual indicium and wherein at least a part of the gripping tab includes the visual indicium.

12. An apparatus configured to removably attach to an access cover of an insulation displacement connector block, wherein the access cover includes a releasable securing mechanism for fixing the access cover in a closed position relative to a cavity within the connector block, the apparatus comprising:

a body adapted to attach to the access cover; and an appendage extending from the body, wherein the appendage is configured to lock the access cover in its closed position;

wherein the releasable securing mechanism of the access cover is a latching mechanism comprising a latching member and a release member moveable between a latched position and a release position, wherein in the latched position, the access cover is fixed in the closed position, and wherein the appendage restricts movement of the release member from its latched position to its release position.

13. The apparatus of claim 12, and wherein at least a part of the body bears a visual indicium.

14. The apparatus of claim 12, wherein the visual indicium is a colored material, a color of the material corresponding to a color-coding scheme.

15. The apparatus of claim 12, and further comprising:

means for aligning the apparatus with respect to the access cover.

16. The apparatus of claim 12, and further comprising a gripping tab extending from the body.

17. An electrical connector assembly comprising:

a housing including an insulation displacement connector element, wherein the insulation displacement connector element is adapted to electrically connect with a conductor partially disposed within the housing;

an access cover connected to the housing; and a circuit marker removably attached to the access cover, the circuit marker including:

a body adapted to attach to the access cover; and means for attaching the body to the access cover, wherein the means includes at least one projection extending from the body and is adapted to engage with a recess formed in the access cover, wherein at least a part of the circuit marker bears a visual indicium and wherein the access cover is moveable between a closed position and an open position, the access cover including a releasable securing mechanism for securing the access cover in the closed position, the releasable securing mechanism including a release member, wherein the release member is moveable between a first position and a second position, and wherein the means for attaching the body to the access cover is capable of limiting movement of the release member from the first position to the second position.

18. The electrical connector assembly of claim 17, wherein the circuit marker comprises a wedge configured to limit movement of the release member.

19. The electrical connector assembly of claim 17 wherein the circuit marker is formed of a material selected from a group consisting of polycarbonate, polypropylene, polyester, and polyethylene.

20. The electrical connector assembly of claim 17, wherein the means for aligning the circuit marker with respect to the access cover comprises a locating pin.

21. The electrical connector assembly of claim 17, wherein the circuit marker further comprises a gripping tab extending from the body.

22. The electrical connector assembly of claim 17, wherein at least a part of the gripping tab includes the visual indicium.

23. The electrical connector assembly of claim 17, wherein the visual indicium is a colored material, a color of the material corresponding to a color-coding scheme.

24. The electrical connector assembly of claim 23, wherein at least a part of the circuit marker is formed of the colored material.

25. The electrical connector assembly of claim 23, wherein the colored material is selected from a group of materials consisting of a red material, a yellow material, a brown material, and a purple material.

* * * * *